US012752952B2

(12) United States Patent
Tucker et al.

(10) Patent No.: US 12,752,952 B2
(45) Date of Patent: Oct. 6, 2026

(54) TOOLING FOR USE IN HEAT-SEALING OF FLEXIBLE MATERIALS USED IN PACKAGING

(71) Applicant: GREENER CORPORATION, Bayville, NJ (US)

(72) Inventors: Steven Tucker, Dallas, TX (US); Richard Hopkins, Atco, NJ (US); Robert Camlin, Toms River, NJ (US); Matthew Wojtech, Charleston, SC (US)

(73) Assignee: GREENER CORPORATION, Bayville, NJ (US)

( * ) Notice: Subject to any disclaimer, the term of this patent is extended or adjusted under 35 U.S.C. 154(b) by 0 days.

(21) Appl. No.: 19/097,435

(22) Filed: Apr. 1, 2025

(65) Prior Publication Data

US 2026/0274484 A1 Sep. 17, 2026

Related U.S. Application Data

(60) Provisional application No. 63/771,792, filed on Mar. 14, 2025.

(51) Int. Cl.
*B65B 51/30* (2006.01)

(52) U.S. Cl.
CPC ..... *B65B 51/30* (2013.01)

(58) Field of Classification Search
CPC ..... B65B 51/30; B65B 51/303; B65B 51/306
See application file for complete search history.

(56) References Cited

U.S. PATENT DOCUMENTS

| | | | | |
|---|---|---|---|---|
| 2,007,047 | A * | 7/1935 | Gibbs | B31F 1/22 427/361 |
| 4,582,555 | A * | 4/1986 | Bower | B29C 66/81435 156/251 |
| 5,021,117 | A * | 6/1991 | Boeckmann | B29C 66/80 156/251 |
| 5,076,040 | A * | 12/1991 | Davis | B29C 66/8167 53/374.6 |
| 5,419,801 | A * | 5/1995 | McDonald | B29C 66/8322 156/581 |
| 6,877,296 | B2 * | 4/2005 | Kohl | B29C 66/8227 53/370.7 |
| 8,572,936 | B2 * | 11/2013 | Mancin | B29C 66/83221 53/374.6 |
| 9,452,853 | B2 * | 9/2016 | Doll | B29C 66/81435 |
| 9,840,346 | B2 * | 12/2017 | Bierschenk | B65B 61/28 |
| 10,683,118 | B2 * | 6/2020 | Yuhara | B29C 65/08 |
| 11,214,034 | B2 * | 1/2022 | Wilcoxen | B31B 70/64 |
| 11,260,603 | B2 * | 3/2022 | Tucker | B65B 51/303 |
| 12,252,286 | B2 * | 3/2025 | Gentili | B29C 65/08 |
| 2011/0000613 | A1 * | 1/2011 | Cigallio | B29C 65/26 156/290 |
| 2011/0030315 | A1 * | 2/2011 | Mancin | B29C 66/83533 53/285 |

(Continued)

FOREIGN PATENT DOCUMENTS

| | | | | |
|---|---|---|---|---|
| EP | 1241098 | A1 * | 9/2002 | B29C 66/73921 |

*Primary Examiner* — Thomas M Wittenschlaeger
(74) *Attorney, Agent, or Firm* — Gregory J. Winsky; ARCHER & GREINER, P.C.

(57) ABSTRACT

In a system for heat-sealing of flexible materials used in packaging of goods, an improved design for a set of heat-seal jaws is described herein.

4 Claims, 9 Drawing Sheets

(56) References Cited

U.S. PATENT DOCUMENTS

| | | | | |
|---|---|---|---|---|
| 2012/0005993 | A1* | 1/2012 | Doll | B29C 66/0042 53/477 |
| 2019/0202587 | A1* | 7/2019 | Yuhara | B29C 65/7451 |
| 2021/0101348 | A1* | 4/2021 | Tucker | B29C 66/73921 |
| 2021/0260633 | A1* | 8/2021 | Boegli | B31F 1/07 |
| 2023/0024331 | A1* | 1/2023 | Gentili | B29C 65/08 |

* cited by examiner

Prior Art System

TOOLING FOR USE IN HEAT-SEALING OF FLEXIBLE MATERIALS USED IN PACKAGING

This application claims the benefit of U.S. provisional application No. 63/771,792 filed on Mar. 14, 2025.

FIELD OF THE INVENTION

The field of the instant invention is systems for heat-sealing of flexible materials used in packaging of goods.

BACKGROUND OF THE INVENTION

The instant invention is an improvement over prior art heat-seal jaws, including, but not limited to, those described and shown in U.S. Pat. No. 11,260,603. Employing the technology disclosed herein provides for improved thermal transfer efficiency over that described in said '603 Patent. This improvement in efficiency manifests itself in certifiable two-sided heating of said flexible materials, yielding higher production speed, improved quality of packaging, and optional lower costs by the use of less expensive packaging materials.

SUMMARY OF THE INVENTION

When packaging manufactured goods into pillow-bags or similar packages made of flexible materials such as flexible polymeric or cellulose films and combinations of same. Conductive heat-sealing of such flexible packaging films is commonly used to protect products from the outside environment. Along with heat and pressure, the process of sealing requires time and that can often be a rate-limiting step in the manufacturing process. The present invention strives to create high-quality package seals as quickly as possible. Improvements in the thermal transfer efficiency of seal jaws yields higher production speeds, improved product quality, and enables the use of less expensive packaging films to provide the same level of quality in packaging.

It is commonly (but mistakenly) believed in the industry that serrated crimp sealers work by compression, i.e., by "squeezing" film together and driving heat into the flexible material from both sides. The instant invention is based on the realization that the relationship of serrated seal jaws to flexible film is driven mainly by tension. Because the relationship is driven by tension, demonstrable conductive heating of the packaging material in prior art embodiments occurs at alternating crowns of each serration from only one side at a time.

The present invention succeeds in this respect not by attempting to manipulate tension as in the '603 Patent, but rather by avoiding the impact of tension on at least one serration. The crown of at least one serration in the present invention is higher than the others, allowing the high crown to push film into the opposing jaw before tension is generated. Thus, film is truly squeezed between opposing seal jaws, which improves the extent of contact area (thus reducing thermal contact resistance and improving thermal transfer efficiency). In addition to contact improvement, this approach has been shown to provide true two-side heating of the flexible film, rather than less effective convection heating in the prior art.

DETAILED DESCRIPTION OF THE INVENTION

When packaging manufactured goods into pillow-bags or similar packages made of flexible materials conductive heat-sealing of such flexible packaging films is commonly used to protect products from the outside environment. Along with heat and pressure, the process of sealing requires time and that can often be a rate-limiting step in the manufacturing process. The present invention strives to create high-quality package seals as quickly as possible. Improvements in the thermal transfer efficiency of seal jaws can yield higher production speeds, improved product quality, and can enable the use of less expensive packaging films. Serrated crimp sealers are thought to work by compression, i.e., "squeezing" film together and driving heat into the flexible material from both sides; however, the instant invention is based on realization that the relationship of serrated seal jaws to flexible film is driven mainly by tension. Because of the influence of tension, conductive heating of the packaging material in prior art embodiments occurs only at the alternating crowns of each serration and only from one side at a time.

The present invention succeeds in two-sided heating not by attempting to manipulate tension as in the '603 Patent, but rather by avoiding the impact of tension on at least one serration. The crown of one serration is higher than the others, allowing the high crown to push film into the opposing jaw before tension is generated. Thus, film is truly squeezed between opposing seal jaws. This alone improves contact area (thus reducing thermal contact resistance and improving thermal transfer efficiency). In addition to any contact improvement, this approach provided true two-side heating of the flexible film.

The instant invention challenges the conventional belief that the jaws close almost completely, separated only by thickness of the film with the result that the film is "squeezed" between seal jaws. The design of the jaws disclosed herein is manifested by insight into the complex interface geometry between crimper and film.

Film tension keeps prior art jaws separated. Film layers are not being squeezed together by the jaws but are pulled together so that the crowns push the inside layer of film into the outside layer, leveraging film tension. Therefore, in the prior art thermal transfer is one-sided and happens only at the crowns. It is widely understood that geometry can be altered to accommodate films of varying thickness and stiffness. For example, a particularly thick, stiff film requires a wider pitch, or distance between crowns. An increase in pitch requires a change in depth and/or angles of the flanks of crowns.

Figure 1:
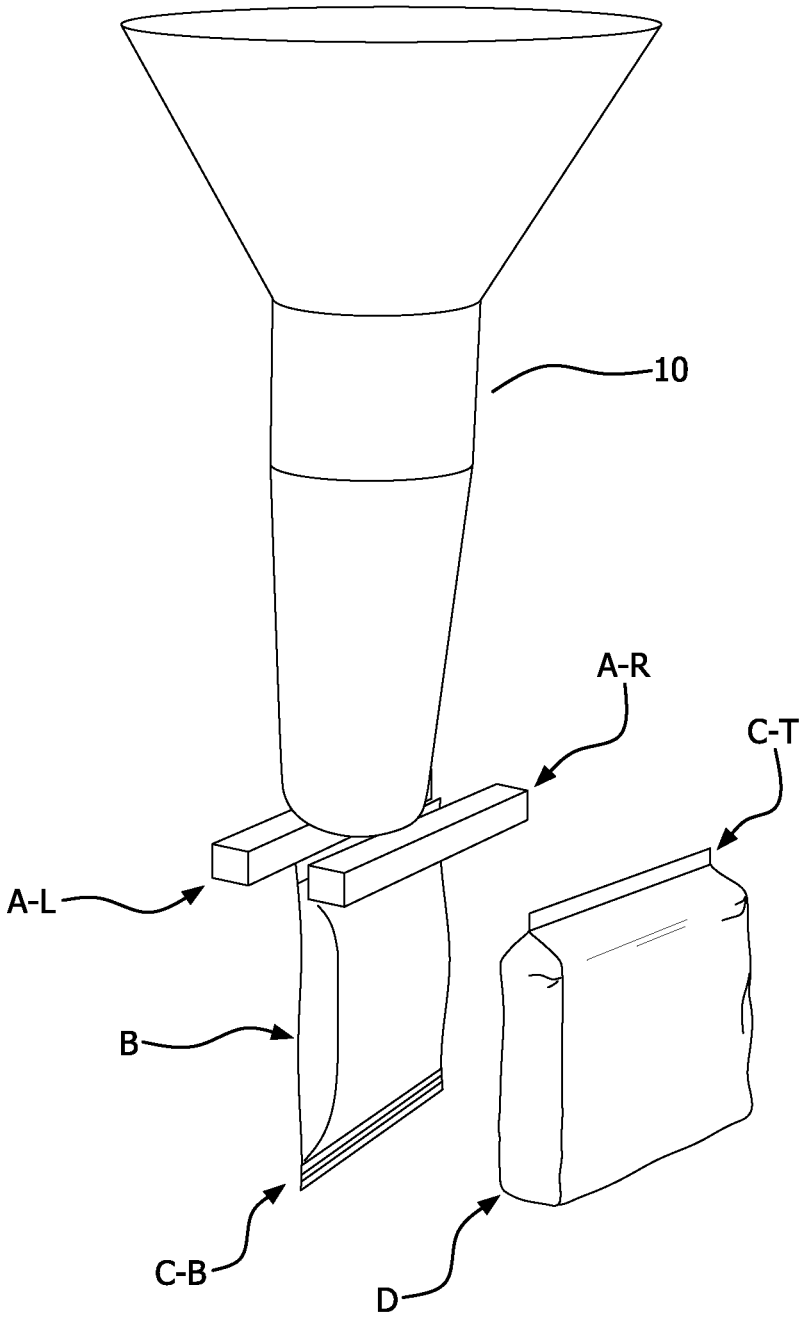
FIG. 1 is a perspective view of a prior art system for packaging goods in flexible packaging material.

A prior art system of packaging of manufactured goods in shown in FIG. 1. Such goods are loaded into a funnel 10 that allows a certain amount of good flow into a sheath of double-sided flexible materials or films B. Heat-seal jaws A-L and A-R, respectfully placed on the left and right sides of sheath B are used to seal the top of what will become a package made from materials B, but also to seal the bottom of the next package to be made from materials B as more products are allowed to flow through funnel 10. Bottom seal C-B of package being filled was created at the same time as the top seal C-T of package D, the two seals having been cut apart by a knife (not shown).

Figure 3:
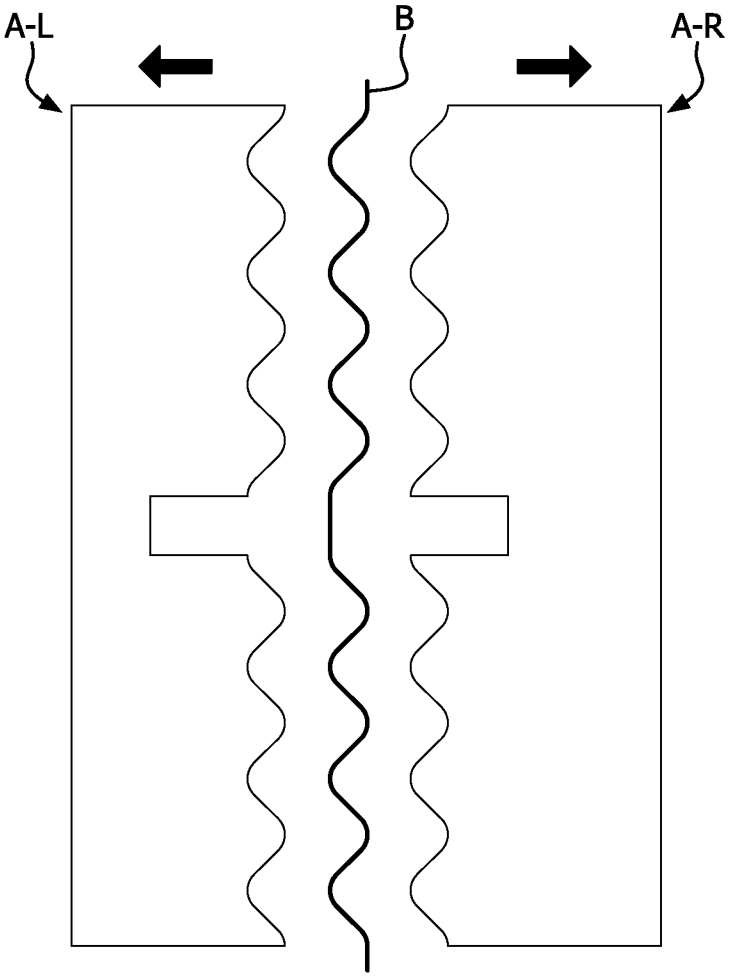
FIG. 3 Prior Art
FIG. 3 is a top plan view of the jaws of FIG. 1 after closing on flexible packaging material.
Figure 2:
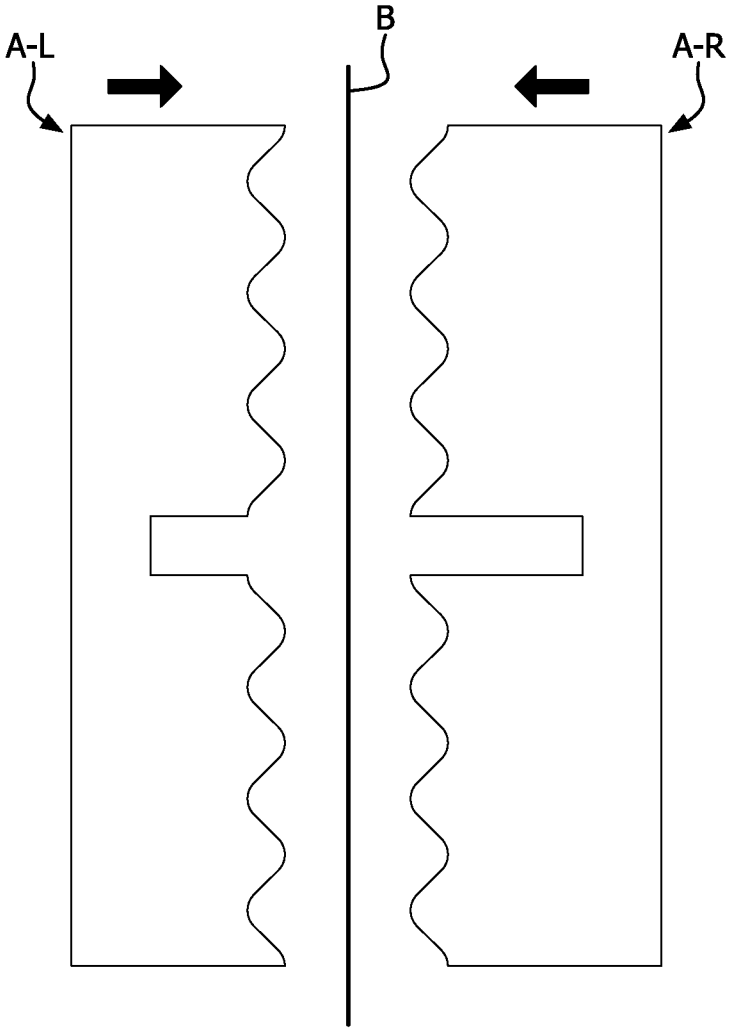
FIG. 2 Prior Art
FIG. 2 is a top plan view of the jaws of FIG. 1 prior to closing on flexible packaging material.
Figure 4:
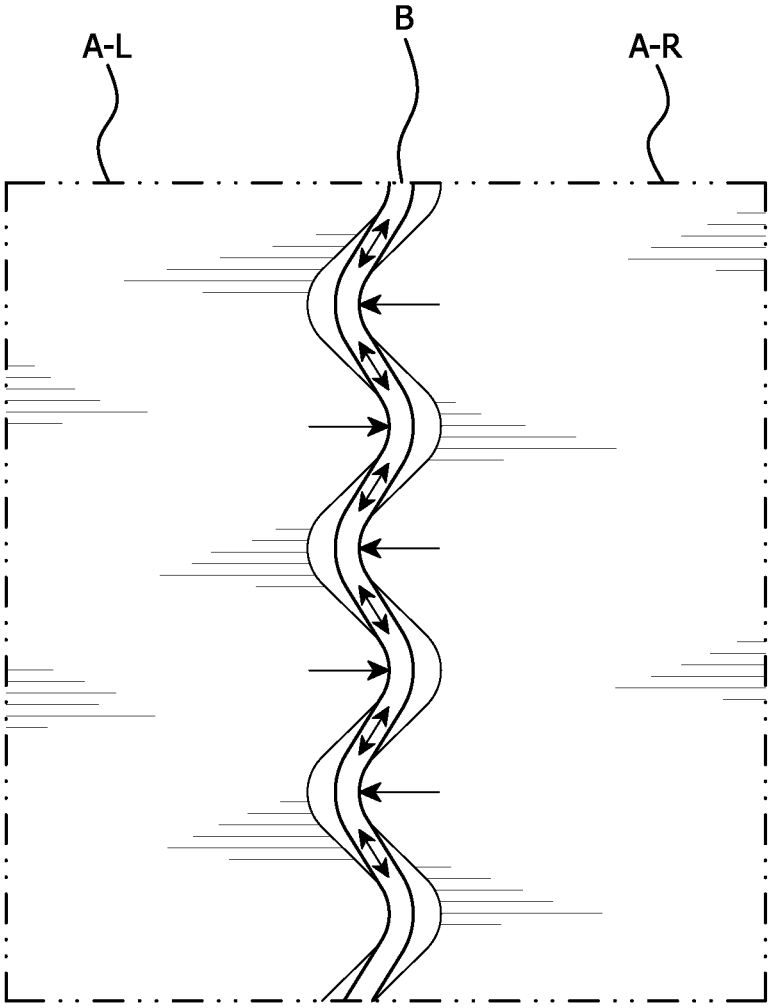
FIG. 4 Prior Art
FIG. 4 is a detailed perspective view of flexible material as shown in the top orthogonal view of the jaws as shown in FIG. 3 after said closing.

Prior art FIG. 2 shows double sided flexible material B placed between left seal jaw A-L and right seal jaw A-R as arrows at the top of the figure show the jaws being closed together. FIG. 3 shows the same prior art jaws after closing on flexible material B and the arrows show the opening of said jaws. In the prior art as shown in FIG. 4, the result of said jaws closing and applying force to material B in in multiple locations. The tensile strength of the film B as shown by the double headed arrows prevents the jaws from fully seating against each other as shown in FIG. 4. As a result, heat is transferred by conduction from the crowns of jaw A-L and jaw A-R only at points of contact as identified shown by the arrows pointing toward the crowns contacting film B.

Figure 5:
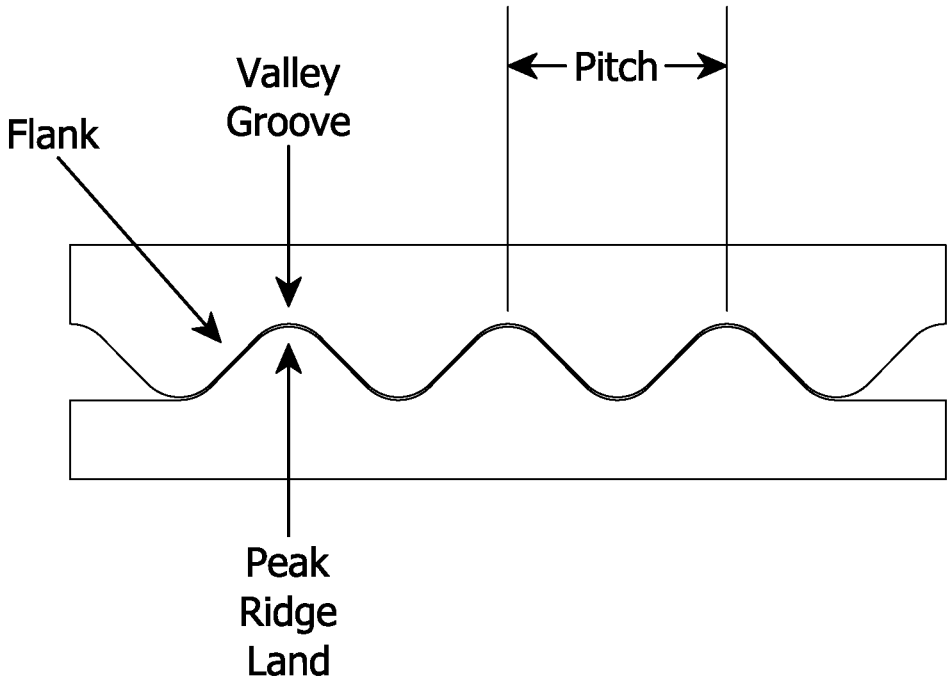
FIG. 5 is a side plan view of generic heat-seal jaws identifying nomenclature used herein in describing the geometry of such jaws.

FIG. 5 depicts generic heat-seal jaws and identifies nomenclature used to describe the geometry of such jaws. Valleys can also be identified as grooves and peaks are referred to as ridges or lands.

Figure 6:
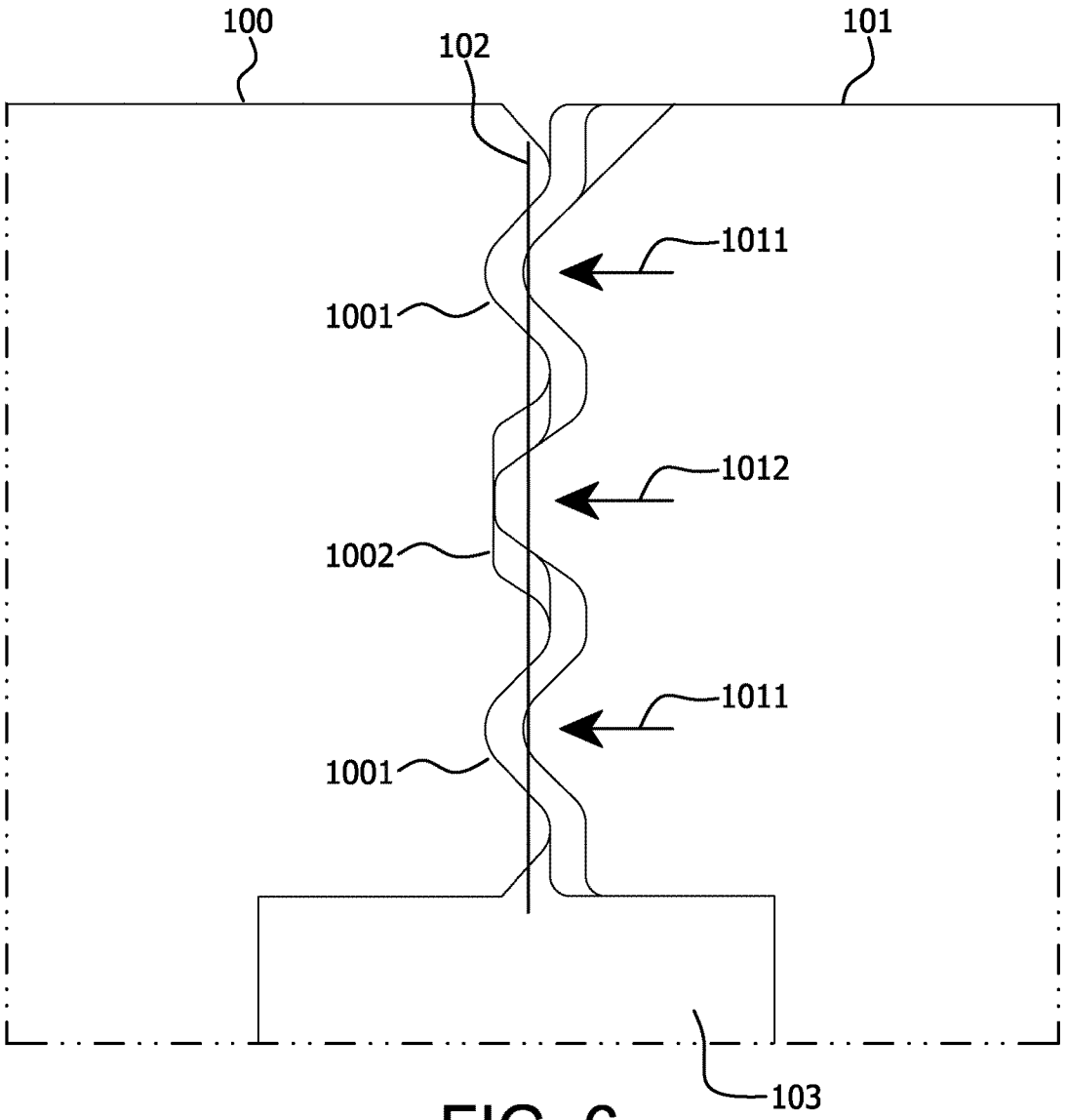
FIG. 6 is a side plan view of one section of heat-seal jaws in the preferred embodiment of the instant invention and the flexible material.

FIG. 6 shows the preferred embodiment of heat-seal jaws as designed in the instant invention. Left jaw 100 having valley 1001 and valley 1002 is shown juxtaposed to right jaw 101 having minor crowns 1011 and major crown 1012. FIG. 6 shows that valley 1001 that is juxtaposed to minor crown 1011 which valley has a lower valley groove depth than valley 1002 that is juxtaposed to major crown 1012 and that said valley groove of said valley 1001 is more rounded than the more flat valley groove of said valley 1002. Opening 103 is a slot for a knife to be used to separate the top seal of one package from the bottom seal of another package as explained in connection with prior art system shown in FIG. 1. Line 102 designates the height of the tops of minor crowns 1011. That crown 1012 exceeds the height of line 102 is the key to the success of the instant invention because the geometry of the jaws is designed to increase the height of one serration relative to the others, with the result that the impact of film tension can be avoided on said high serration. Jaws 100 and 101 bottom out as crown 1012 seats into valley 1002 before film tension is generated at the minor serrations, as shown in FIG. 6 as minor crowns 1011 have not seated into valleys 1001. Since said seal jaws are fully seated at the high serration, that is where crown 1012 has contacted valley 1001, heat transfer efficiency is improved, and conduction becomes two-sided. The two-sided heat transfer is significantly more efficient, enabling adequate heat transfer to occur in less time and at a lower temperature.

Figure 7:
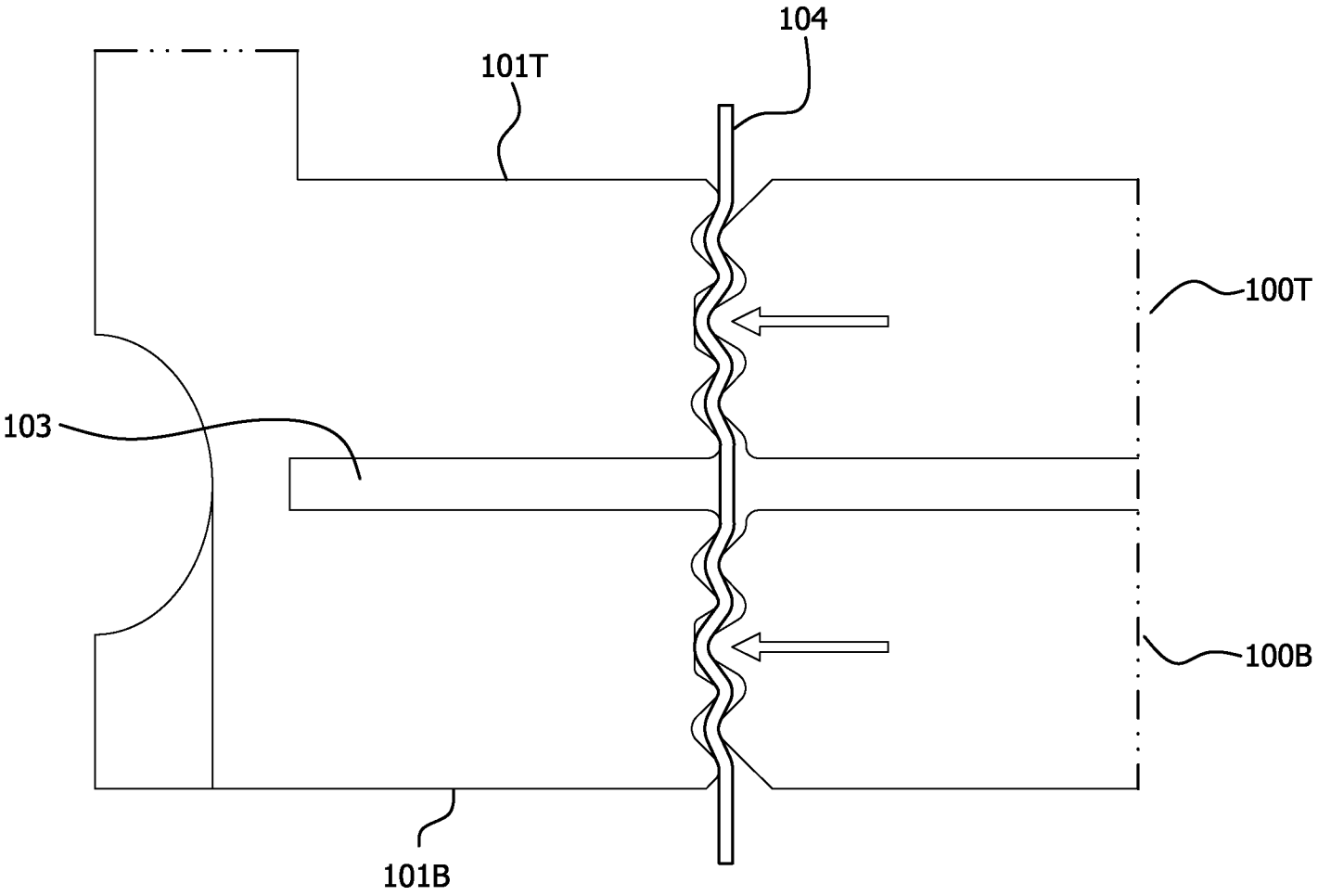
FIG. 7 is a side plan view of the jaws in the preferred embodiment of the instant invention closing on the flexible material.

FIG. 7 shows a complete set of complementary jaws of the instant invention inside view: left top jaw 100T and left bottom jaw 100B closing together on right top jaw 101T and right bottom jaw 101B, with knife slot 103 shown in its entirety. Film 104 is shown between the entirety of said complementary jaws 100 and 101 with arrows indicating the contacting of the major crowns of the left jaws 100T and 100B into the complementary valleys of jaws 101T and 101B.

Figure 8:
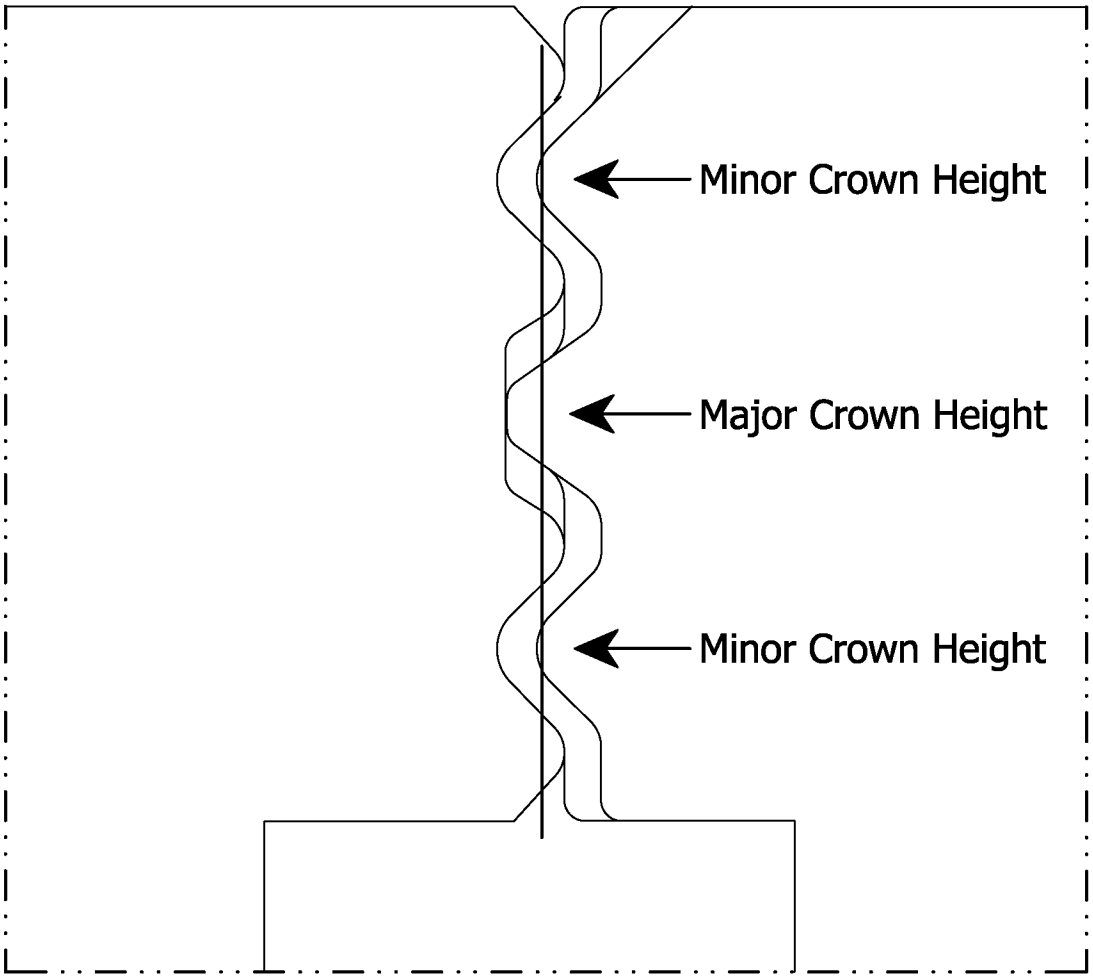
FIG. 8 is a side view of a series of roots and crowns on a first jaw juxtaposed with a second jaw in the preferred embodiment of the instant invention.

FIG. 8 shows the geometry of the crowns and valleys for one heat-seal jaw of the preferred embodiment of the instant invention marked to distinguish major crown heights from minor crown heights. It should be noted that such heights of the crowns alternate in FIG. 8.

Figure 9:
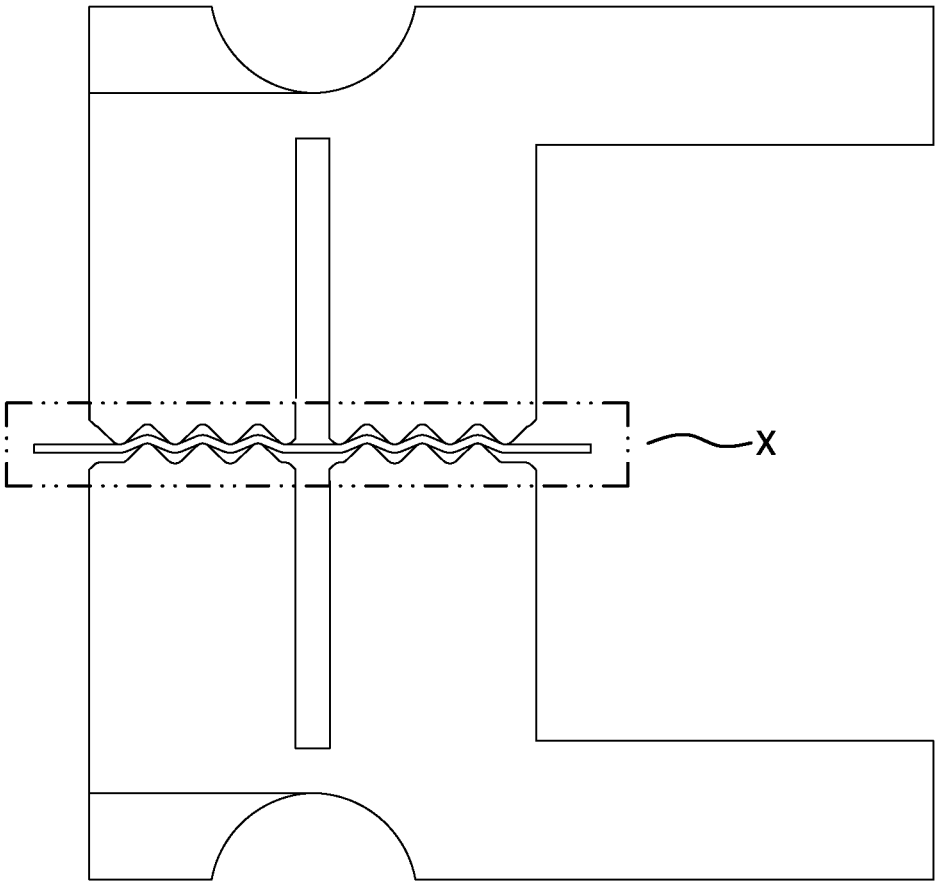
FIG. 9 Prior Art
FIG. 9 is a top plan view of prior art complementary jaws closed on flexible material.
Figure 10:
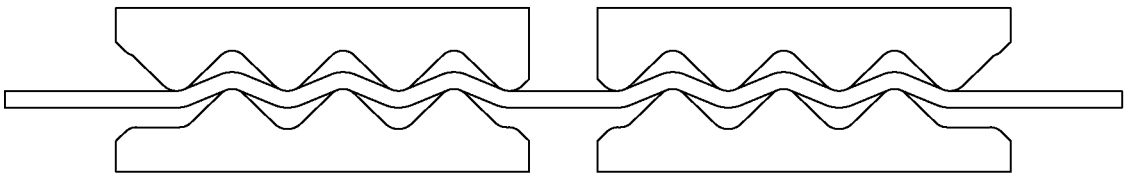
FIG. 10 Prior Art
FIG. 10 is a sectional detailed view of section X of FIG. A-5.
Figure 11:
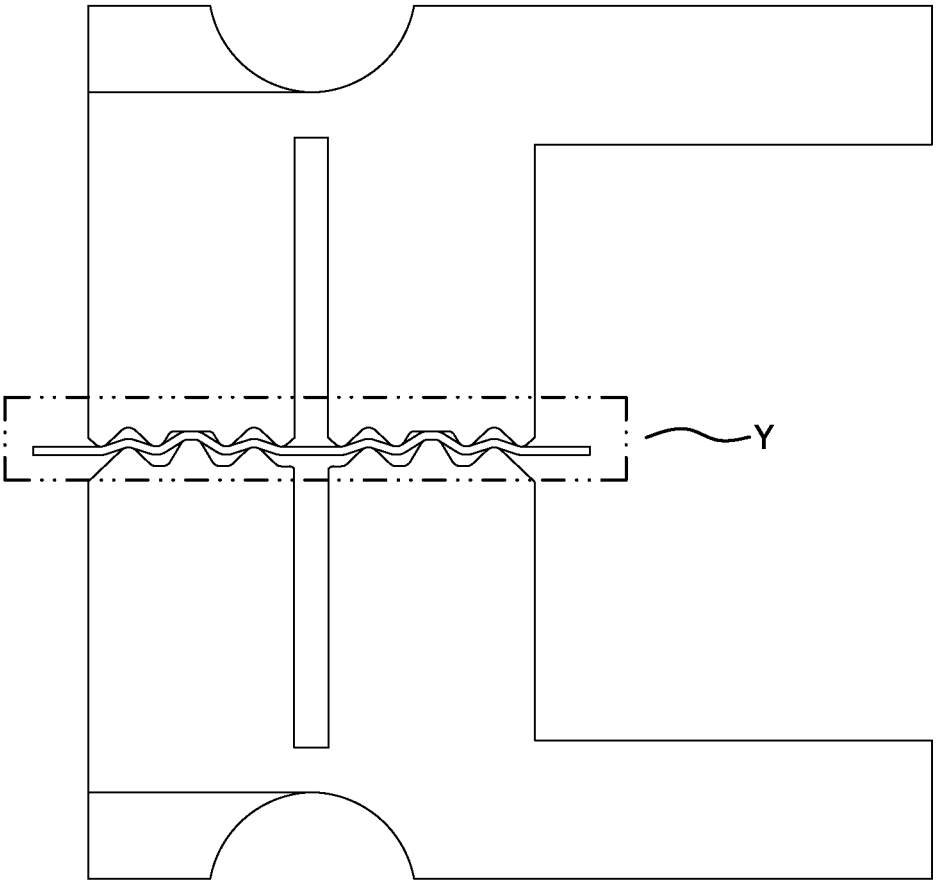
FIG. 11 is a top plan view of complementary jaws of the preferred embodiment closed on flexible material.
Figure 12:
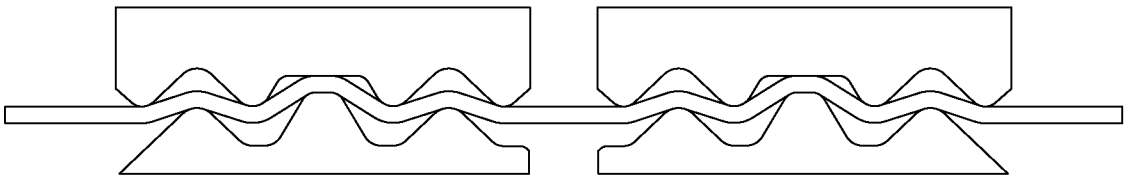
FIG. 12 is a sectional detailed view of section Y of FIG. 5.

The figures on drawings 8/9 and 9/9 provide a comparison of the prior art jaws to the jaws of the preferred embodiment of the instant invention. Specifically, FIG. 9 shows prior art jaws closed on film with FIG. 10 providing a detailed view of section X of FIG. 11, compared with FIG. 11 that shows jaws of the instant invention closed on film with FIG. 12 providing a detailed view of section Y of FIG. 1.

The instant disclosure should not be read to limit the concepts described herein to particular disclosed forms, especially to the preferred embodiment as set forth herein. Specific examples and dimension and angles have been disclosed by way of example only. The intent of this disclosure is to cover all modifications, equivalents, and alternative designs and embodiments that are within the spirit and scope of the instant invention as defined in this specification and in the claims.

The invention claimed is:

1. A set of heat-seal jaws comprising:

a first jaw having at least three valleys each of which having a depth and shape of valley groove, and a second jaw having at least three peaks each of which having a height such that a peak that is a minor crown has a lesser height than a peak that is a major crown;

wherein each of said peaks is juxtaposed to one of said at least three valleys;

whereby each major crown is juxtaposed to a valley having a higher valley depth, each minor crown is juxtaposed to a valley having lower valley depth and a rounded shape, and each minor crown is flanked by a major crown.

2. The set of heat-seal jaws of claim 1 further comprising a knife slot.

3. An improvement in heat-seal jaws, the improvement comprising:

in a first jaw of said set of heat-seal jaws at least three valleys each of which having a depth and shape of valley groove, and in a second jaw of said set of heat-seal jaws at least three peaks each of which having a height such that a peak that is a minor crown has a lesser height than a peak that is a major crown;

wherein each of said peaks is juxtaposed to one of said at least three valleys;

whereby each major crown is juxtaposed to a valley having a higher valley depth, each minor crown is juxtaposed to a valley having lower valley depth and a rounded shape, and each minor crown is flanked by a major crown.

4. A method of heat-sealing of flexible packaging materials comprising the steps of:

positioning said flexible material between a first heat-seal jaw and a second heat-seal jaw, heating each of said first heat-seal jaw and said second heat-seal jaw, closing said first heat-seal jaw and said second heat-seal jaw on said flexible material; and opening said first heat-seal jaw and said second heat seal jaw, whereby said flexible material is sealed by heat transfer applied by two-sided heating of said material and by the application of force by the closing of said jaws, which first jaw having at least three valleys each of which having a depth and shape of valley groove, and which second jaw having at least three peaks each of which having a height such that a peak that is a minor crown has a lesser height than a peak that is a major crown;

wherein each of said peaks is juxtaposed to one of said at least three valleys, each major crown is juxtaposed to a valley having a higher valley depth, each minor crown is juxtaposed to a valley having lower valley depth and a rounded shape, and each minor crown is flanked by a major crown.

* * * * *